United States Patent [19]

Marcus et al.

[11] Patent Number: 4,854,638

[45] Date of Patent: Aug. 8, 1989

[54] PORTABLE ADJUSTABLE CHILD'S CHAIR

[75] Inventors: Kenneth N. Marcus, Tipp City; Phillip L. Brookshire, Cincinnati, both of Ohio

[73] Assignee: Dolly, Inc., Tipp City, Ohio

[21] Appl. No.: 270,742

[22] Filed: Nov. 14, 1988

[51] Int. Cl.[4] ..... A47C 1/08

[52] U.S. Cl. ..... 297/250; 297/444; 297/464; 297/DIG. 2

[58] Field of Search ..... 297/250, 253, 464, 444, 297/150, 153, DIG. 2

[56] References Cited

U.S. PATENT DOCUMENTS

| | | | |
|---|---|---|---|
| D. 148,380 | 11/1948 | Noel . | |
| D. 152,383 | 1/1949 | Waaranan . | |
| D. 157,959 | 4/1950 | Kahan . | |
| D. 246,642 | 12/1977 | Nakoa . | |
| 1,465,291 | 8/1923 | Walker | 297/150 |
| 2,466,350 | 5/1949 | Anderson | 297/138 |
| 2,530,474 | 11/1950 | Lutes | 297/153 |
| 3,078,101 | 2/1963 | Reese | 280/30 |
| 3,335,434 | 8/1967 | Gamon | 5/332 |
| 3,575,465 | 4/1971 | Dolby et al. | 297/118 |
| 4,109,961 | 8/1978 | Opsrik | 297/338 |
| 4,453,764 | 6/1984 | Hennessy | 297/153 |
| 4,563,040 | 1/1986 | Alster | 297/440 |
| 4,770,468 | 9/1988 | Shubin | 297/250 |

FOREIGN PATENT DOCUMENTS

| | | | |
|---|---|---|---|
| 3517841 | 11/1986 | Fed. Rep. of Germany | 297/250 |

*Primary Examiner*—James T. McCall

*Attorney, Agent, or Firm*—Killworth, Gottman, Hagan & Schaeff

[57] ABSTRACT

A portable adjustable child's chair which may be converted into a booster seat or high chair. Removable seat and back panels permit both height and depth adjustment of the child's chair by selectively inserting the panels into one or another of a series of generally horizontal and generally vertical grooves in the side panels.

19 Claims, 4 Drawing Sheets

20
14
3
2
4
4
9
1
13
5
5
15'
19
4
13'
7
3'
11
25
21
10

PORTABLE ADJUSTABLE CHILD'S CHAIR

BACKGROUND OF THE INVENTION

This invention relates to a portable adjustable child's chair having a means for adjusting seat panel elevation and back panel depth to form a chair of desired height and depth. It also relates to a portable adjustable child's chair which is convertible into a booster seat or high chair.

Booster seats are well known as a means of seating children in conventional chairs at tables of various height. While individual booster seats have been manufactured in different sizes to accommodate smaller or larger children, none adapt to accommodate children as they grow in size.

Combination chair assemblies are also well known, wherein a chair, in combination with various support structures, serves a plurality of purposes, including use as a high chair. For example, U.S. Pat. No. 2,530,474 shows a chair assembly functioning as a rocking chair, swing, high chair with removable tray, or straight chair. The chair seat, removable to allow the straight chair configuration to function as a nursery toilet, performs no adjustment function. U.S. Pat. No. 3,078,101 shows a chair that may also serve as a high chair, stroller, and lounge chair. Again, this chair seat, while removable, performs no adjustment function. The back panel, however, does recline by means of a hinge and support. While versatile, the '474 and '101 patents do not teach the removal or adjustment of seat or back panels as a means to adjust the height and depth of chair size.

However, chair arrangements are known having means for adjusting seat panel elevation to adapt to growing children. U.S. Pat. No. 3,575,465 shows a modular construction adaptable for a multitude of furniture purposes including chairs, shelves, bookcases, beds, clothes racks, tables, and dividers. The '465 patent includes as a feature the use of a plurality of spaced grooves or channels which slidably receive and maintain planar accessory elements to permit variation of seat level when the modular construction is used as a chair. So used, the back is rigid and not susceptible of any adjustment.

U.S. Pat. No. 4,109,961 shows an adjustable chair having a plurality of horizontal grooves or channels on uprights which permit the variation of seat level of the chair. The '961 patent teaches the use of a second plate, interchangeable with the seat panel, to serve as a footrest and support which enables children of any age and size to use the chair. The chair stands on its own and accommodates, by varying the seat and footrest height, the seating of its occupant at standard tables. This invention also includes a seat belt for use by young children, but no tray. The uprights shown in the '961 patent are connected at three points: at their lower ends by a cross piece, at their middle by a cross bar, and most notably at the upper end by a back rest plate. Screw nuts at these connections provide, when tightened, the pressure necessary to retain the seat and footrest plates. Accordingly, in all instances, the back rest plate remains fixed.

Additionally, the use of removable trays, seat belts, and straps for securing seats to supports in combination with children's chairs are known in the prior art. Removable trays are shown by U.S. Pat. Nos. Des. 148,380; Des. 152,383; Des. 157,959; 2,530,474; 3,078,101; 3,335,434; Des. 246,642; and 4,453,764. Seat belts are shown by U.S. Pat. Nos. 3,335,434 and 4,109,961, and fabric straps for attachment to an existing base are shown by U.S. Pat. No. 3,335,434.

As can be seen the prior art reveals a long-time concern with versatility of function in children's furniture. But, a drawback has been the need to transport support bases with seats outside the home and a lack of suitability for children of different sizes. More recently, the focus has been on the adjustability of children's chairs. However, known chairs, while somewhat adjustable, still lack portability and, as complete pieces of furniture, maybe aesthetically incompatible with existing furniture.

Accordingly, there remains a need for portable, adjustable, combination child's chair, booster seat and high chair which may be used with existing furniture and which may be easily stored when not in use.

SUMMARY OF THE INVENTION

The portable, adjustable combination child's chair, booster seat and high chair of the present invention features side panels having a series of generally horizontal and vertical grooves or channels on their inner surfaces into which separate back and seat panels may be variously inserted to form a chair of desired height and depth. The side panels are separated and supported by means which, in combination with the side panels, form a stable rigid frame. The overall structure therefore permits the child's chair to be easily adjusted to accommodate growing children. Its size makes it readily portable and easily stored.

Additionally, means for retaining the occupant in the chair, such as an adjustable seatbelt, may be used. Further, means for securing the child's chair to an existing chair or support, such as adjustable straps, may be used to convert the chair to a booster seat. Finally, a serving tray may be removably attached to the side panels for the use by the occupant. So used, the portable adjustable child's chair may function as a play chair, and when secured to an existing chair or support, function as a high chair.

DESCRIPTION OF THE PREFERRED EMBODIMENTS

Figure 1:
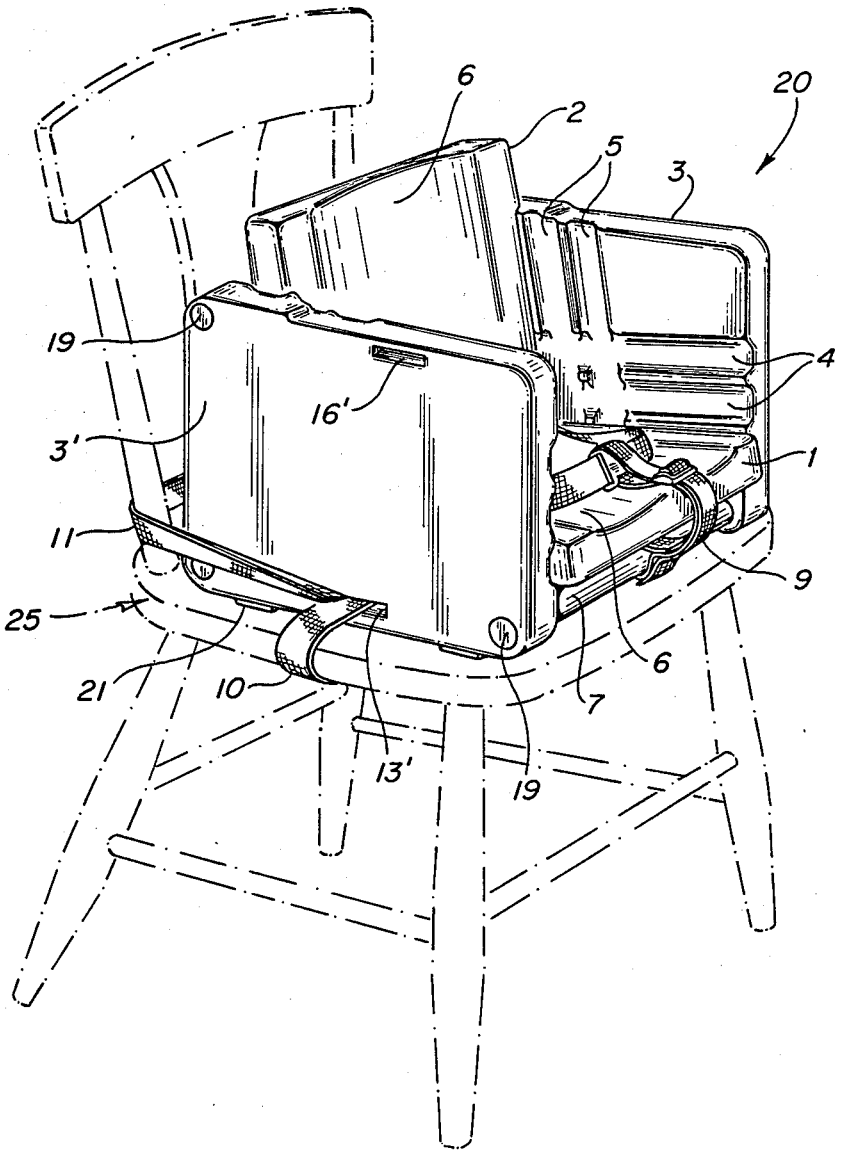
FIG. 1 is a perspective view of the child's chair of the present invention showing the seat panel low and back panel rearward.
Figure 2:
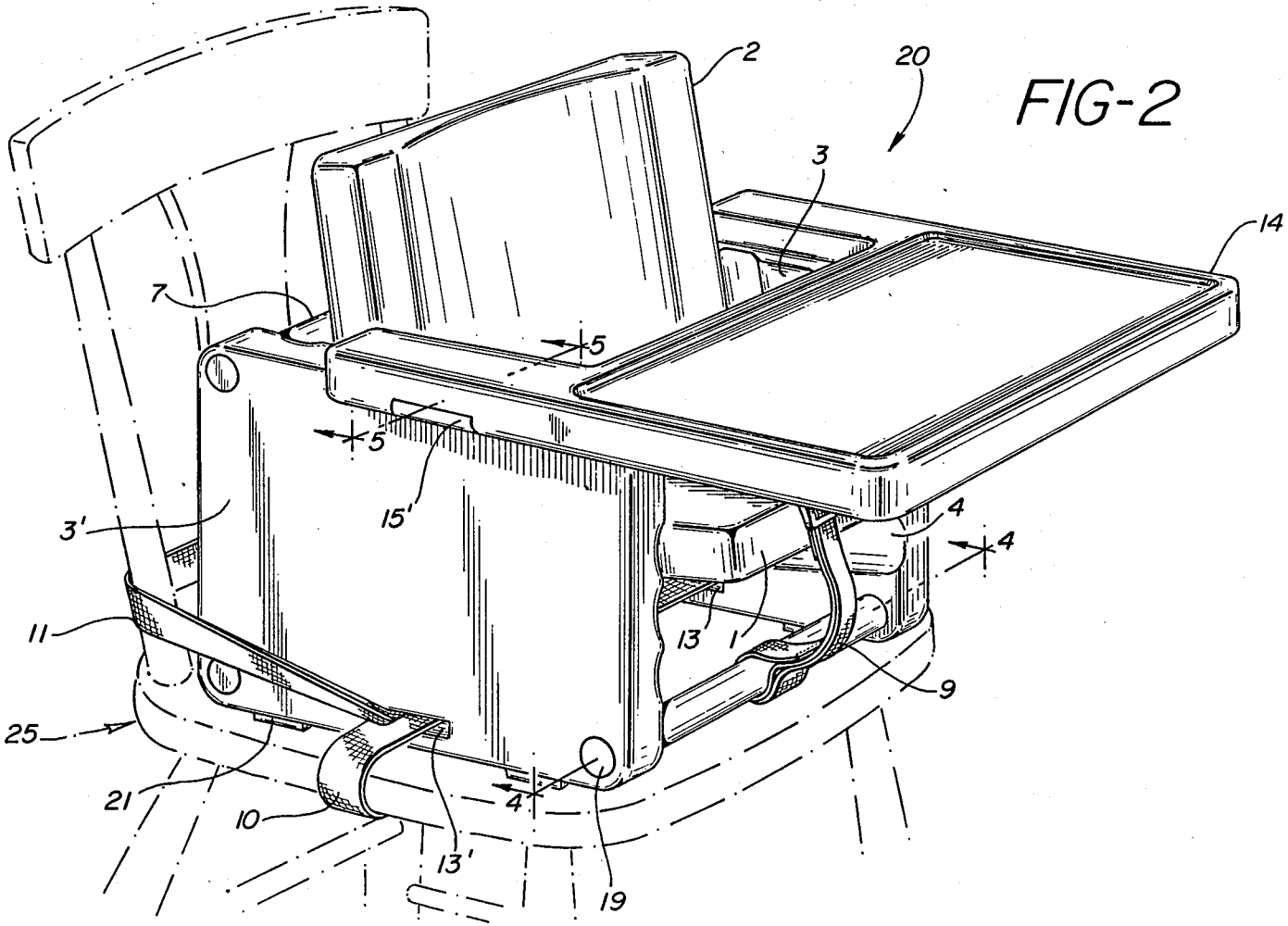
FIG. 2 is a perspective view of the child's chair of FIG. 1 incorporating the tray and showing the seat panel elevated and back panel forward.

Referring to the drawings, FIGS. 1 and 2 show the portable, adjustable child's chair, generally indicated at 20. FIGS. 1 and 2 comprise separate embodiments of the present invention. While shown functioning in FIGS. 1 and 2 as a booster chair and high chair, respectively, the child's chair 20 may be also used separately on the floor as a play chair, with or without tray 14, ideal for meals, crafts, or watching television.

Figure 3:
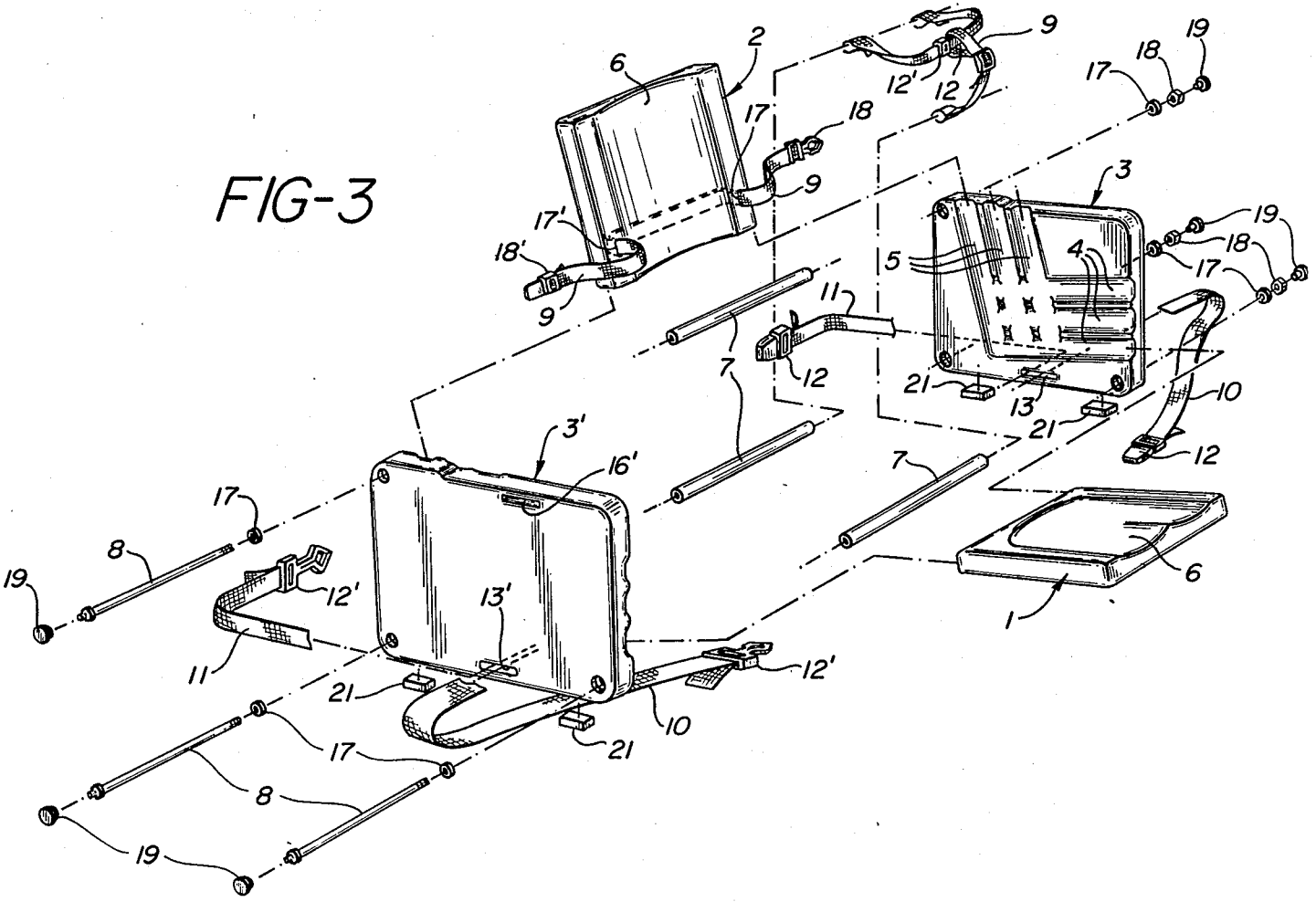
FIG. 3 is an exploded perspective of the child's chair of the present invention showing the relationship of the various panels and structure.

Briefly, referring to FIGS. 1 and 3, child's chair 20 includes two side panels 3, 3' which in combination with tubular supports 7 and tie rods 8 form a frame into which a seat panel 1 and a back panel 2 may be slidably inserted.

The side panels 3 and 3' each have a plurality of generally horizontal grooves or channels 4 and generally vertical grooves or channels 5 for adjusting the height and depth of the seat panel 1 and back panel 2 respectively. It should be noted that the grooves 4 and 5 can be varied in angle from precise horizontal and vertical orientation, preferably being angularly displaced to recline somewhat the seat panel 1 and back panel 2 panels as shown in FIGS. 1–3. Further, while the preferred embodiment shows only three horizontal grooves 4 and three vertical grooves 5, the number of grooves or channels may be varied to provide greater or lesser adjustability.

To enhance the portability of the child's chair 20, the side panels 3, 3', seat panel 1, and back panel 2, are made of lightweight material, such as plastic, blow-molded in a manner generally known in the art. Similarly, the three tubular supports 7 are lightweight, made of commercially available plastic tube, molded or extruded in a manner generally known in the art.

Figure 4:
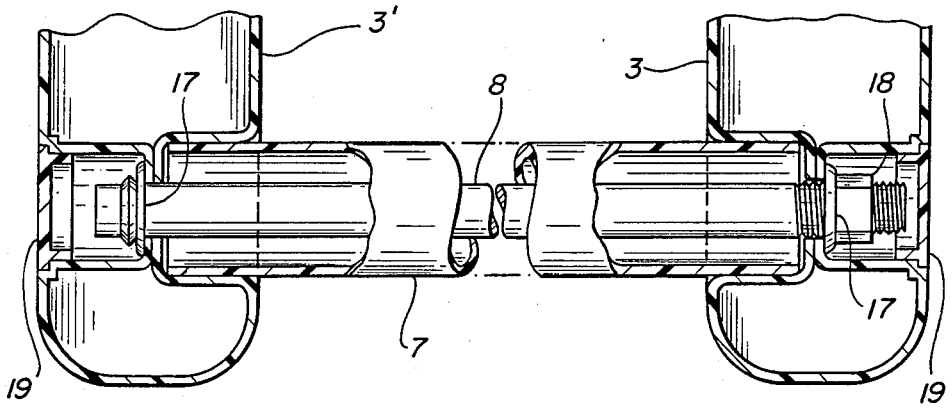
FIG. 4 is a cross-sectional view taken along line 4—4 of FIG. 2 showing means of supporting the side panels and attachment thereto.

The tubular supports 7 and tie rods 8 work in combination to separate and support the side panels 3, 3' to form a stable rigid frame. Referring to FIGS. 3 and 4 the tie rod 8, made of commercially available metal pipe or rod, preferably steel, has a circumferential bead at one end and is threaded at the other. So made, tie rod 8 may be fitted with a washer 17 at the beaded end and the threaded end passed first through one side panel, through tubular support 7 through the second side panel, and finally fitted with washer 17, and screw nut 18.

Screw nuts 18, when tighted, compress the tubular supports 7 separating the side panels 3, 3', and thereby form a stable rigid frame. The openings on the outer surfaces of side panels 3 and 3' are then covered by molded plastic caps 19.

The seat panel 1 and back panel 2 are contoured as illustrated by numeral 6 for the comfort and safety of the occupant. The contour 6 aids in retaining the occupant in the child's chair 20 by friction which is further enhanced when the seat panel 1 is slightly reclined.

The remaining elements of the invention, soft rubber feet 21, a seat belt 9, chair straps 10 and 11, and a serving tray 14 are optional, although desirable and preferred in practicing the invention. Commercially available, four soft rubber feet 21, two each attached to the bottom edges of side panels 3, 3', add stability and skid-resistance to child's chair 20 and protect existing chairs 25 or supports, as shown in FIGS. 1 and 2. A seat belt 9 for retaining the occupant in the child's chair 20 is shown in FIGS. 1–3. Commercially available fabric seat belts 9 having adjustable interlocking ends 12 and 12' may be used. As shown in FIGS. 1 and 3, two segments of the seat belt 9 may be passed between seat panel 1 and back panel 2 and looped around rear tubular support 7 to provide waist restraint, while the third segment is looped around front tubular support 7 to provide crotch restraint for the occupant. Preferably, the seat belt loops are sewn and looped around tubular supports 7 during assembly.

Referring to FIG. 1, fabric chair straps 10 and 11 are threaded side-to-side through slots 13 and 13' centrally located along the bottom edge of each of side panels 3 and 3'. Chair straps 10 and 11 are then passed under and around an existing chair 25 or other support to secure the child's chair 20 onto the existing chair 25 where it functions as a booster seat. Such fabric straps are commercially available and have interlocking ends 12 and 12' as shown in FIG. 3. Such interlocking ends 12 and 12' also preferably have means for adjusting the length of the strap. Alternatively, the either chair strap 10 or 11 could be threaded front to back by removing the strap from slots 13 and 13', passing the strap below the seat panel 1, looping the strap around each of the two bottom support tubes 7, and thence under the existing chair 25. In either case, the chair straps 10 and 11 are adjusted to secure the booster seat snugly to an existing chair 25 or support.

Figure 5:
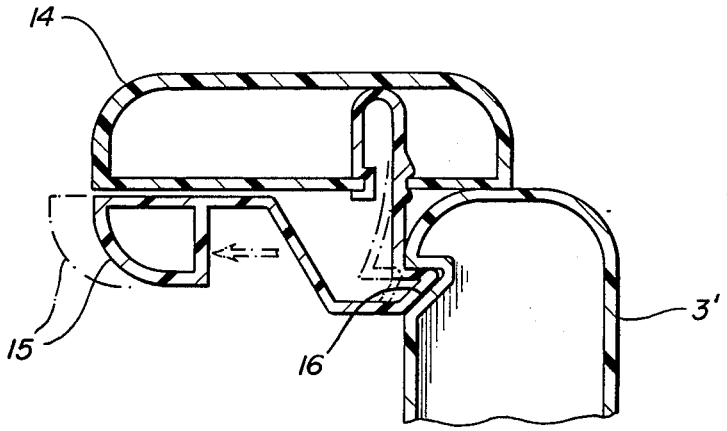
FIG. 5 is a cross-sectional view taken along line 5—5 of FIG. 2 showing the side panel notch and tray latch.

With reference to FIG. 2, a serving tray 14 is attached to and supported by the top edges of the side panels 3 and 3'. In this embodiment the child's chair 20 is converted into a high chair. Latches 15 and 15' on each arm of the tray 14 snap into notches 16 and 16' near the top outer edge of each side panel as shown in FIG. 5. The bottom surfaces of the tray arms are indented to conform to the top edge of the side panels upon which the tray rests to add stability to the assembly. FIG. 3 shows a single notch 16 and 16' in each side panel, preferable to afford both stability to the tray 14 and a full range of seat adjustment. Multiple sets of notches, to permit adjustment of tray location, are also possible. The tray 14 is made of blow-molded plastic, and its light weight enhances its portability, use, and storage.

Having described the invention in detail, what is claimed is:

1. A portable adjustable child's chair, comprising:

(a) a seat panel;

(b) a back panel;

(c) two side panels having on their inner surfaces facing each other a plurality of generally horizontal grooves or channels to slidably receive said seat panel whereby said seat panel may be raised or lowered, said side panels further having on their inner surfaces facing each other a plurality of generally vertical grooves or channels to slidably receive said back panel, whereby said back panel location may be adjusted forward or rearward; and (d) a stable rigid frame which is formed in part from said side panels and which along with said seat panel and said back panel provides a body supporting feature, said stable rigid frame being self-supporting and free-standing, whereby said child's chair is readily portable and easily stored.

2. A portable adjustable child's chair as recited in claim 1 wherein said back panel and said seat panel are contoured.

3. A portable adjustable child's chair as recited in claim 1 wherein said generally horizontal grooves or channels are angularly displaced to recline said seat panel and said generally vertical grooves or channels are angularly displaced to recline said back panel.

4. A portable adjustable child's chair as recited in claim 1 wherein said stable rigid frame includes a plurality of tubular supports and tie rods separating and interconnecting rigidly said side panels.

5. A portable child's chair as recited in claim 1 further comprising means for retaining the occupant in said child's chair.

6. A portable adjustable child's chair as recited in claim 5 wherein said means for retaining the occupant comprises a seat belt.

7. A portable adjustable child's chair as recited in claim 5 further comprising means for securely attaching said child's chair to an existing chair or other support.

8. A portable adjustable child's chair as recited in claim 1 further comprising means for securely attaching said child's chair to an existing chair or other support.

9. A portable adjustable child's chair as recited in claim 8 wherein said means for securely attaching said child's chair comprises multiple straps passing through said side panels said straps capable of being passed under around, or behind an existing chair or other support, each of said straps further having means for adjusting the length of said strap and having means for interconnecting the opposite ends of said strap.

10. A portable adjustable child's chair as recited in claim 1 further comprising:

a serving tray; and means for removably attaching said tray to said child's chair.

11. A portable adjustable child's chair as recited in claim 10 wherein said means for removably attaching said tray consists of means of latching and supporting said tray on said side panels.

12. A portable adjustable child's chair as recited in claim 10 further comprising means for retaining the occupant in said child's chair.

13. A portable adjustable child's chair as recited in claim 10 further comprising means for securely attaching said child's chair to an existing chair or other support.

14. A portable adjustable child's chair as recited in claim 1 further comprising means to enhance contact of said chair with support surfaces.

15. A portable adjustable child's chair as recited in claim 14 wherein said means to enhance contact of said child's chair with support surfaces are soft, rubber feet attached to the bottom edges of said side panels.

16. A portable adjustable child's chair, comprising:

(a) a contoured seat panel;

(b) a contoured back panel;

(c) two side panels having on their inner surfaces facing each other a plurality of generally horizontal grooves or channels to slidably receive said seat panel whereby said seat panel may be raised or lowered; and (d) a stable rigid frame which is formed in part from said side panels and which along with said seat panel and said back panel provides a body supporting feature, said stable rigid frame being self-supporting and free-standing, whereby said child's chair is readily portable and easily stored.

17. The portable adjustable child's chair of claim 16 further comprising:

a serving tray; and means for removably attaching said tray to said child's chair.

18. The portable adjustable child's chair of claim 17 wherein said side panels further have on their inner surfaces facing each a plurality of generally vertical grooves or channels to slidably receive said back panel, whereby said back panel location may be adjusted forward or rearward, said generally vertical grooves or channels also being angularly displaced to recline said back panel.

19. The portable adjustable child's chair of claim 17 further comprising means for retaining the occupant in said child's chair and means for securely attaching said child's chair to an existing chair or other support.

* * * * *